US008943637B2

(12) United States Patent
Gavney, Jr. et al.

(10) Patent No.: US 8,943,637 B2
(45) Date of Patent: Feb. 3, 2015

(54) MULTI-DIRECTIONAL WIPING ELEMENTS AND DEVICE USING THE SAME

(71) Applicants: James Albert Gavney, Jr., Palo Alto, CA (US); Jerry Mix, Redwood City, CA (US); Dennis Boyle, Palo Alto, CA (US); Rickson Sun, Palo Alto, CA (US); Christopher Loew, Palo Alto, CA (US); Pascal Homero Soboll, London (GB); Daniel Sung-hwe Kim, Mountain View, CA (US)

(72) Inventors: James Albert Gavney, Jr., Palo Alto, CA (US); Jerry Mix, Redwood City, CA (US); Dennis Boyle, Palo Alto, CA (US); Rickson Sun, Palo Alto, CA (US); Christopher Loew, Palo Alto, CA (US); Pascal Homero Soboll, London (GB); Daniel Sung-hwe Kim, Mountain View, CA (US)

( * ) Notice: Subject to any disclaimer, the term of this patent is extended or adjusted under 35 U.S.C. 154(b) by 0 days.

(21) Appl. No.: 13/573,598

(22) Filed: Sep. 27, 2012

(65) Prior Publication Data

US 2014/0041137 A1 Feb. 13, 2014

Related U.S. Application Data

(63) Continuation of application No. 11/004,394, filed on Dec. 3, 2004, now Pat. No. 8,276,233, which is a continuation of application No. 10/454,281, filed on Jun. 3, 2003, now Pat. No. 6,859,969, which is a continuation-in-part of application No. 09/588,686, filed on Jun. 5, 2000, now Pat. No. 6,571,417, which is a continuation-in-part of application No. 09/330,704, filed on Jun. 11, 1999, now Pat. No. 6,319,332.

(60) Provisional application No. 60/439,317, filed on Jan. 10, 2003.

(51) Int. Cl.

| | |
|---|---|
| ***A46B 9/04*** | (2006.01) |
| ***A47L 13/11*** | (2006.01) |
| ***A46B 9/00*** | (2006.01) |

(52) U.S. Cl.

CPC . *A46B 9/04* (2013.01); *A46B 9/005* (2013.01); *A46B 9/045* (2013.01); *A46B 2200/1066* (2013.01)

USPC ..... 15/117; 15/4; 15/22.1; 15/97.1; 15/110; 15/114; 15/167.1; 15/245

(58) Field of Classification Search

USPC ..... 15/4, 22.1, 97.1, 110, 114, 117, 167.1, 15/188, 245, 245.1

See application file for complete search history.

(56) References Cited

U.S. PATENT DOCUMENTS

| | | | | |
|---|---|---|---|---|
| 1,191,556 | A * | 7/1916 | Blake | 15/117 |
| 1,833,555 | A * | 11/1931 | Bell et al. | 15/188 |
| 1,993,662 | A * | 3/1935 | Green | 15/110 |

FOREIGN PATENT DOCUMENTS

| | | |
|---|---|---|
| GB | 2 371 217 A | 7/2002 |
| WO | WO 01/21036 | 3/2001 |

OTHER PUBLICATIONS

DM/045 025, International Bulletin, Aug. 1998, 5 Pages.

*Primary Examiner* — Randall Chin

(74) *Attorney, Agent, or Firm* — James A. Gavney, Jr.; JAG Patent Services

(57) ABSTRACT

Multi-directional wiping elements are disclosed. The wiping elements comprise intersecting squeegee segments that provide top wiping squeegee edges and side wiping squeegee edges. Devices utilizing the multi-directional wiping elements of the present invention can include bristles that are configured to simultaneously wipe a working surface with the wiping elements. In accordance with the embodiments of the invention, the multi-directional wiping elements are utilized in a toothbrush cleaning head that is configured to be operated manually or, alternatively, is motorized and is configured to rotate, oscillate, vibrate and/or move according to a combination thereof.

14 Claims, 9 Drawing Sheets

MULTI-DIRECTIONAL WIPING ELEMENTS AND DEVICE USING THE SAME

RELATED APPLICATION(S)

This Application is a Continuation Application of the application Ser. No. 11/004,394, filed Dec. 3, 2004, titled "MULTI-DIRECTIONAL WIPING ELEMENTS AND DEVICES USING THE SAME", now U.S. Pat. No. 8,276,233, which is a Continuation Application of the application Ser. No. 10/454,281, filed Jun. 3, 2003, titled "MULTI-DIRECTIONAL WIPING ELEMENTS AND DEVICES USING THE SAME", now U.S. Pat. No. 6,859,969, which is a Continuation-in-part of the application Ser. No. 09/588,686, filed Jun. 5, 2000, and titled "DENTITION CLEANING DEVICE AND SYSTEM", now U.S. Pat. No. 6,571,417, which is a Continuation-in-part of application Ser. No. 09/330,704 filed Jun. 11, 1999, and titled "SQUEEGEE DEVICE AND SYSTEM", now U.S. Pat. No. 6,319,332. The application Ser. No. 11/004,394, filed Dec. 3, 2004, titled "MULTI-DIRECTIONAL WIPING ELEMENTS AND DEVICES USING THE SAME" now U.S. Pat. No. 8,276,233, and the U.S. Pat. Nos. 6,859,969 6,571,417 and 6,319,332, are all hereby incorporated by reference. This Patent Application also claims priority under 35 U.S.C. 119 (e) of the U.S. Provisional Patent Application Ser. No. 60/439,317, filed Jan. 10, 2003, and titled "TOOTHBRUSH". The U.S. Provisional Patent Application Ser. No. 60/439,317 filed Jan. 10, 2003, and titled "TOOTHBRUSH", is also hereby incorporated by reference.

FIELD OF THE INVENTION

This invention relates generally to wiping devices. More specifically this invention relates to wiping devices with multi-directional wiping elements.

BACKGROUND

There are a number of different systems and devices available for cleaning teeth and gums. A number of these available systems and devices are inefficient at cleaning teeth and gums and require multiple pass scrubbing with oral cleaning agents, such as tooth pastes or gels, to effectively clean teeth and gums. Typically, toothbrushes do not efficiently apply the oral cleaning agents to teeth and gums and can be abrasive, causing loss of healthy gun tissue and/or damage to teeth. Further, toothbrushes can require a high degree of technique and/or dexterity to be used effectively for cleaning teeth and gums.

What is needed is a dentition cleaning system and device that can efficiently apply oral cleaning agents to teeth and gums and that can clean teeth and gums without a high degree of technique or dexterity. Further, what is needed is a dentition cleaning system and device that is less abrasive to teeth and gums than a conventional bristle toothbrush.

SUMMARY OF THE INVENTION

The present invention is directed to a device comprising a cleaning head or an applicator head with a squeegee element having intersecting squeegee segments. Preferably, the device is an oral care device, such as a toothbrush. Alternatively, the device is a cleaning device or applicator configured for medical, household, garden and/or industrial use.

In accordance with the embodiments of the invention, the cleaning head or applicator head is coupled or configured to be detachably coupled to a handle for manually cleaning or applying materials to a working surface. Alternatively, the cleaning head or applicator head is coupled to or configured to be detachably coupled to a motorized handle, wherein the motorized handle provides vibration, rotation and/or oscillation to the squeegee element having intersecting squeegee segments.

In yet further embodiments of the invention, the cleaning head or applicator head further comprises bristles or bristle sections that are configured to treat a working surface simultaneously with a squeegee element comprising intersecting squeegee segments. Preferably, at least a portion of the squeegee segments provide top wiping edges and side wiping edges (viz. has a terminus end) and the bristles surround or flank at least a portion of the top wiping edges. Squeegee segments, in accordance with the embodiments of the invention, are curved, protrude from a support surface to a range of heights, are contoured to have any number of different shapes, or any combination thereof. For example, squeegee walls, side wiping edges and/or top wiping edges are contoured to be corrugated, rounded, angled, pointed and/or tapered. Also, squeegee segments can protrude from different angles relative to a support structure and/or relative to each other. Further, a portion of the squeegee segments can be free from the support structure to allow the free portion to be readily moved in a fanning motion when contacted with a sufficient force, while another portion of the squeegee segments remain secured to the support structure.

In accordance with still further embodiments of the invention, a device comprises a continuous squeegee segment which forms or bounds an inner squeegee region and an outer squeegee region and squeegee fins or segments with top and side wiping squeegee edges. The squeegee fins or segments preferably protrude from an inner squeegee wall of the continuous squeegee segment, an outer squeegee wall of the continuous squeegee segment or a combination thereof. Also, bristles or bristle sections can protrude from within the inner squeegee region, the outer squeegee region or a combination thereof.

DETAILED DESCRIPTION

Figure 1:
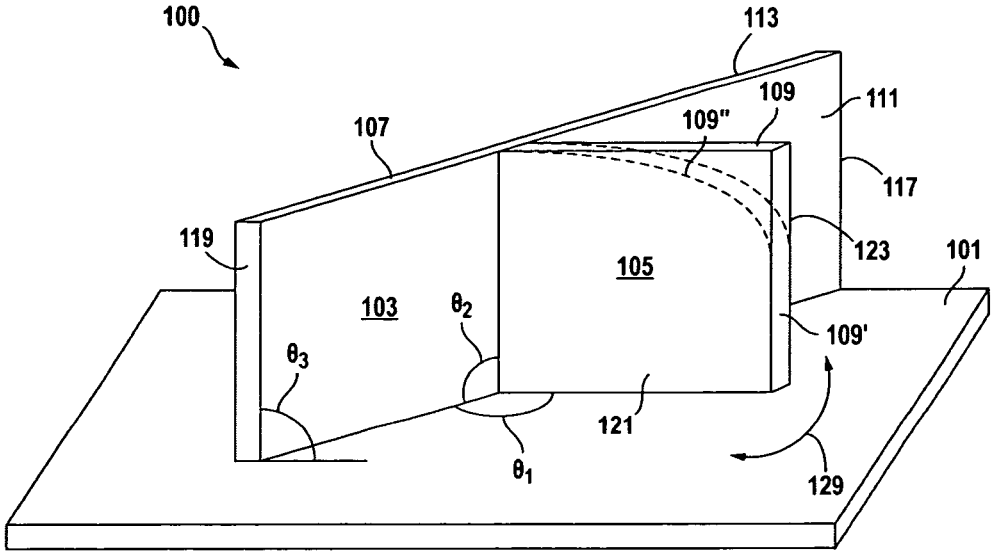
FIG. 1 shows a squeegee element with intersecting squeegee segments and providing top wiping edges and side wiping edges, in accordance with the embodiments of the invention.

Squeegees and/or portions thereof, in accordance with the embodiments of the present invention, are preferably configured to clean surfaces, apply materials to surfaces and/or otherwise treat surfaces. In accordance with a preferred embodiment of the invention, squeegees are configured to treat dentition. Squeegees, utilized in the present invention, can be formed from any number of different materials, but are preferably formed from a resilient polymeric material such as silicon, latex, rubber, polyurethane or a combination thereof. Preferably, squeegees, or a portion thereof, are formed from a material, or materials, that can be molded and that result in squeegees with hardness values in a range of 10 to 100 Shores A, as defined in the D2240-00 Standard Test Method for Rubber Property-Durometer Hardness, published by the American Society for Testing Materials, the contents of which are hereby incorporated by reference. Also, squeegees, in accordance with the present invention, are coupled with a variety of different elements, including but not limited to, bristle elements, scouring elements, sponge elements and the like. Further, devices utilized in squeegee configurations of the present invention can comprise apertures to dispense materials onto a working surface and/or remove materials from the working surface. Squeegees, in accordance with still further embodiments of the present invention, include an abrasive material that is integrated with the material(s) used to form the squeegees and/or are applied to surfaces of squeegee walls and/or edges after they are formed. Further details of squeegees and uses thereof are described in U.S. Pat. No. 6,319,332 and U.S. Pat. No. 6,463,619 both entitled "Squeegee Devices and Systems", the contents of which are hereby incorporated by reference.

Squeegee configurations, in accordance with the embodiments of the invention, comprise one or more squeegee elements with intersecting squeegee segments. For example, squeegee elements can comprise one or more major, or primary, squeegee segments and one or more minor, or secondary, squeegee segments. The minor, or secondary, squeegee segments are also referred to herein as fins, are generally smaller than the major, or primary, squeegee segments and are attached to a wall of a major, or primary, squeegee segment.

The squeegee fins preferably provide top wiping edges and side wiping edges. The major squeegee segments are curved squeegee segments, continuous squeegee segments, spiraling squeegee segments or squeegee arrays and can have one or more terminus ends to also provide one or more side wiping edges. Edges and walls of the squeegee segments, in accordance with yet further embodiments, are shaped, contoured or textured in any number of different ways.

Briefly, squeegee elements utilized in accordance with the present invention can have segments that protrude to different heights and that extend in different directions. Squeegee elements can include squeegee segments forming one or more terminus ends and/or squeegee segments that are continuous and have no ends. Preferably, the squeegee elements have intersecting squeegee segments that provide for top wiping edges and side wiping edges and are integrated into a cleaning head of a manual or motorized toothbrush with, or without, bristle sections. The squeegee segments can intersect at any number of different angles with respect to each other and with respect to a support structure. Also, top wiping edges, side wiping edges and walls of the squeegee segments can be shaped or contoured in any number of ways. For example, top and/or side wiping squeegee edges are corrugated, rounded angled and/or pointed and walls are curved, textured and/or tapered. Further, squeegee elements and/or portions thereof can include an abrasive material. Methods and materials for making molded abrasive structures are described in U.S. Pat. No. 6,126,533, and titled "MOLDED ABRASIVE BRUSH", the contents of which are hereby incorporated by reference.

It is understood that squeegee geometries, squeegee configurations, preferred physical properties and materials used to form squeegees described above apply to all of the examples herein. Further, while direct reference to squeegee segment heights and widths is not made, it will be understood by one skilled in the art that any number of different dimensions are within the scope of the invention and preferred choices will depend on the intended application. Also, it is noted that details of the preferred dimensions for squeegee elements suitable for use in oral care systems and devices are described in U.S. patent application Ser. No. 09/588,686, titled "DENTITION CLEANING DEVICE AND SYSTEM", now U.S. Pat. No. 6,571,417, the contents of which are hereby incorporated by reference.

FIG. 1 shows a squeegee configuration 100, or a portion of a squeegee configuration, in accordance with the embodiments of the present invention. The squeegee configuration 100 comprises a primary elongated squeegee segment 103 with squeegee walls 111 and 113 that can protrude from a surface 101 to provide an elongated squeegee edge 107. The primary squeegee segment 103 can have any number of different geometries, such as described above, but is shown here as squeegee segment 103 with two ends to provide two side wiping edges 117 and 119.

Still referring to FIG. 1, the squeegee configuration 100 also comprises one or more secondary squeegee segments 105 with squeegee walls 121 and 123 that extend out from the at least one of the walls 111 and 113 of the primary squeegee segment 103 (in this case 111) to provide a top wiping edge 109. Further, the secondary squeegee segment 105 has at least one terminus end to provide a side wiping squeegee edge 109'. The secondary squeegee segment 105, in accordance with alternative embodiments, has a curved squeegee edge, as indicated by the dotted lines 109", that provides for both top wiping and side wiping edges. The walls 111, 113, 121 and 123 and the edges 107, 109, 109' 117, 113 and 119 can be contoured or textured in any number of different ways, as explained above.

Still referring to FIG. 1, the secondary squeegee 105, in accordance with the embodiments of the invention, can extend out from the wall 111 of the major squeegee segment 103 by any number of different angles $\theta_1$ and $\theta_2$ (for example, less than 90 degrees) and the primary squeegee segment 103 can protrude from the surface 101 by any number of different angles $\theta_3$ suitable for the application at hand. Also, secondary squeegee segment 105 can be coupled to the surface 101 or can be free from the surface 101, such that the secondary squeegee segment 105 moves in a fanning motion, as indicated by the arrow 129, when a sufficient deforming force is applied to the secondary squeegee segment 105.

Figure 2:
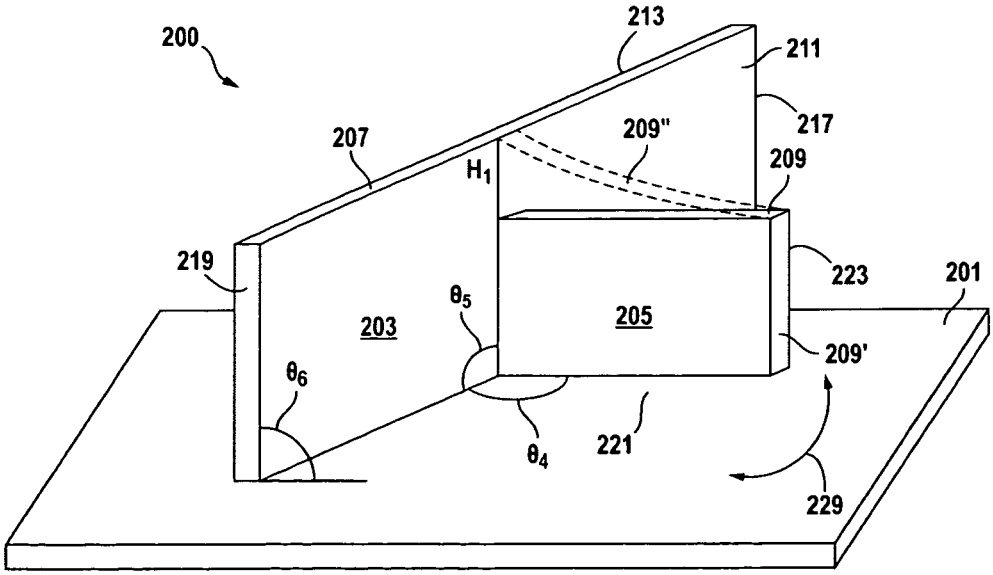
FIG. 2 shows a squeegee element with intersecting squeegee segments and providing top wiping edges and side wiping edges, in accordance with further embodiments of the invention.

FIG. 2 shows a squeegee configuration 200, or a portion of a squeegee configuration, in accordance the embodiments of the present invention. The squeegee configuration 200 comprises a primary elongated squeegee segment 203 with squeegee walls 211 and 213 that can protrude from a surface 201 to provide an elongated squeegee edge 207. The primary squeegee segment 203 can have any number of different geometries, such as described above, but is shown here as squeegee segment 203 with two ends to provide two side wiping edges 217 and 219.

Still referring to FIG. 2 the squeegee configuration 200 also comprises one or more secondary squeegee segments 205 with squeegee walls 221 and 223 that extend out from the at least one of the walls 211 and 213 of the primary squeegee segment 203 (in this case 211) to provide a top wiping edge 209 that is lower in height, relative to the surface 201 than the wiping edge 207 of the primary squeegee segment 203. Further, the secondary squeegee segment 205 has at least one terminus end to provide a side wiping squeegee edge 209'.

In accordance with yet further embodiments of the invention, the minor squeegee segment 205 has a curved squeegee edge, as indicated by the dotted lines 209", that provides an angled top wiping edge as well as the side wiping edge 209'. The walls 211, 213, 221 and 223 and the edges 207, 209, 209', 209", 217 and 219 can be contoured or textured in any number of different ways, as explained above. Again the secondary squeegee segment 205 can extend out from the wall 211 of the major squeegee segment 203 by any angles $\theta_4$ and $\theta_5$ and the primary squeegee segment 203 can protrude from the surface 201 at any number of different angles $\theta_6$ suitable for the application at hand. Also, secondary squeegee segment 205 can be coupled to the surface 201, or can be free from the surface 201 such that the secondary squeegee segment 205 moves in a fanning motion, as indicated by the arrow 229, when a sufficient deforming force is applied to the secondary squeegee segment 205.

Figure 3:
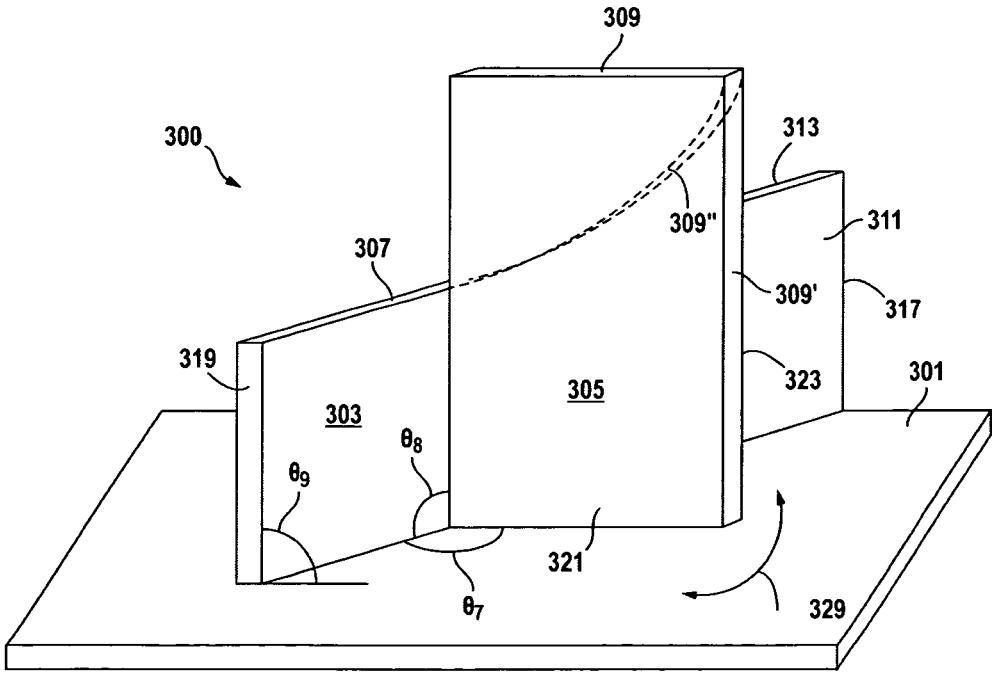
FIG. 3 shows a squeegee element with intersecting squeegee segments and providing top wiping edges and side wiping edges, in accordance with yet further embodiments of the invention.

FIG. 3 shows a squeegee configuration 300, or a portion of a squeegee configuration, in accordance the embodiments of the present invention. The squeegee configuration 300 comprises a primary squeegee segment 303 with squeegee walls 311 and 313 that can protrude from a surface 301 to provide top wiping edges 307. The primary squeegee segment 303 can have any number of different geometries, such as described above, but is shown here as squeegee segment 203 with two ends to provide two side wiping edges 317 and 319.

Still referring to FIG. 3 the squeegee configuration 300 also comprises one or more secondary squeegee segments 305 with squeegee walls 321 and 323 that extend out from at least one of the walls 311 and 313 of the primary squeegee segment 303 (in this case 311) to provide a top wiping edge 309 that is higher in height relative to the surface 301 than the wiping edge 307 of the primary squeegee segment 303. Further, the secondary squeegee segment 305 has at least one terminus end to provide a side wiping squeegee edge 309'.

In accordance with yet further embodiments of the invention, the secondary squeegee segment 305 has a curved squeegee edge, as indicated by the dotted lines 309" that provides an angled top wiping edge as well as the side wiping edge 309'. The walls 311, 313, 321 and 323 and the edges 307, 309, 309', 309", 317 and 319 can be contoured or textured in any number of different ways, as explained above. Again the secondary squeegee segment 305 can extend out from the wall 311 of the major squeegee segment 303 by any number of angles $\theta_7$ and $\theta_8$ and the primary squeegee segment 303 can protrude from the surface 301 by any number of different angles $\theta_9$ suitable for the application at hand. Also, secondary squeegee segments 305 can be coupled to the surface 301 or can be free from the surface 301 such that the secondary squeegee segment 305 moves in a farming motion, as indicated by the arrow 329, when a sufficient deforming force is applied to the secondary squeegee segment 305.

FIGS. 4A-G illustrated top views of squeegee configurations, or portions thereof, in accordance with further embodiments of the invention, wherein intersecting squeegee segments have different lengths, the same lengths, different heights or the same heights to provide top wiping edges and side wiping edges. Squeegee configurations, or portions thereof, as described with reference to FIGS. 4A-G, can include bristles that protrude from a support surface to the same heights or different heights from the squeegee segments. Also the squeegee configurations can include bristles that protrude from the support surface at the same angles or different angles relative to the surface from that of the squeegee segments.

Figure 4A:
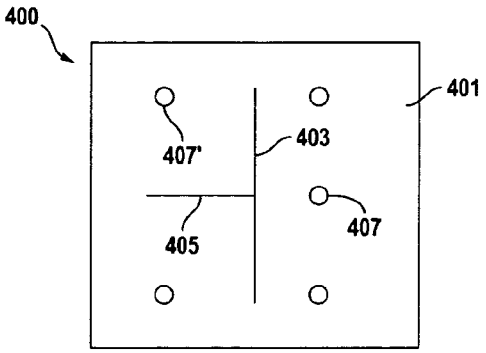
FIGS. 4A-J illustrate top views of squeegee configurations with intersecting squeegee segments and bristles or bristle sections, in accordance with the embodiments of the invention.

Referring now to FIG. 4A, a squeegee configuration 400, in accordance with the embodiments of the invention, comprises elongated squeegee segments 403 and 405 that intersect and provide top wiping edges and side wiping edges, as explained above. One, or both, of the elongated squeegee segments 403 and 405 protrude from a support surface 401 and can be surrounded or flanked by bristles or bristle sections 407 and 407' that also protrude from the support surface 401 and are preferably configured to wipe a working surface (not shown) simultaneously with the top wiping edges of the elongated squeegee segments 403 and 405.

Figure 4B:
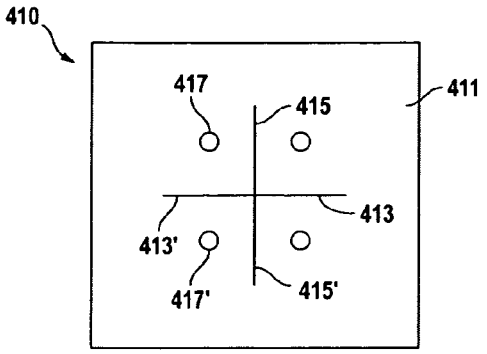

Referring now to FIG. 4B, a squeegee configuration 410, in accordance with the embodiments of the invention, comprises elongated squeegee segments 413, 413', 415 and 415' that intersect and provide top wiping edges that form a cross-shape and side wiping edges. One or more of the elongated squeegee segments 413, 413', 415 and 415' protrude from a support surface 411 and can be surrounded or flanked by bristles or bristle sections 417 and 417' that also protrude from the support surface 411 and are preferably configured to wipe a working surface (not shown) simultaneously with the top wiping edges of the elongated squeegee segments 413, 413', 415 and 415'.

Figure 4C:
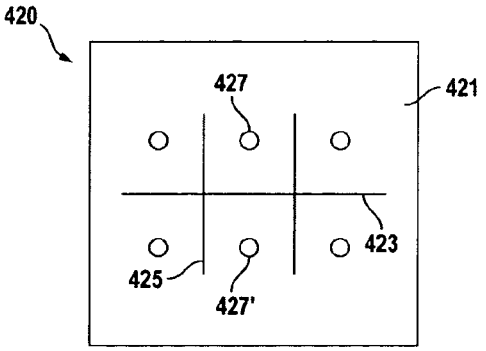

Referring now to FIG. 4C, a squeegee configuration 420, in accordance with the embodiments of the invention, comprises a major elongated squeegee segment 423 and a plurality of minor intersecting squeegee segments 425 and 425' that intersect with a wall of the major elongated squeegee segment to provide cross-like top wiping edges and side wiping edges. One or more of the major squeegee segment 423 and the minor squeegee segments 425 and 425' protrude from a support surface 421 and can be surrounded or flanked by bristles or bristle sections 427 and 427' that also protrude from the support surface 421 and are preferably configured to wipe a working surface (not shown) simultaneously with the top wiping edges of the squeegee segments 423, 425 and 425'.

Figure 4D:
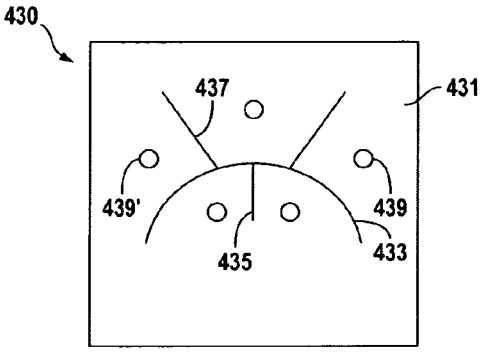

Referring now to FIG. 4D, a squeegee configuration 430, in accordance with the embodiments of the invention, comprises one or more curved squeegee segments 433 and a plurality intersecting squeegee segments 435 and 437. The intersecting squeegee segments 435 and 437 can extend from inside of the curvature of the squeegee segment 433, such as 435, or radiate outward from outside of the curvature of the squeegee segment 433, such as 437, to provide top wiping edges and side wiping edges. The curved squeegee segment 433 and the intersecting squeegee segments 435 and 437 protrude from a support surface 431 and can be surrounded or flanked by bristles or bristle sections 439 and 439' that also protrude from the support surface 431 and are preferably configured to wipe a working surface (not shown) simultaneously with the top wiping edges of the curved 433 and intersecting squeegee segments 435 and 437.

Figure 4E:
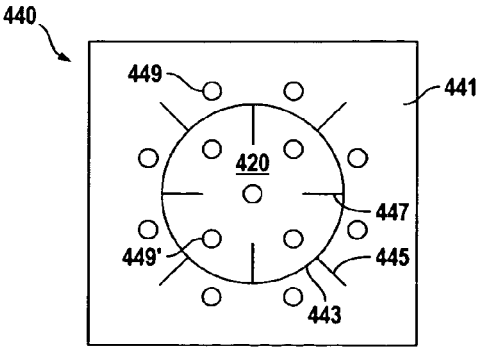

Referring now to FIG. 4E, a squeegee configuration 440, in accordance with the embodiments of the invention, comprises a curved and continuous squeegee segment 443 that forms or bounds an inner squeegee region 420 and an outer squeegee region 422. The squeegee configuration 440 can further comprise intersecting squeegee segments 447 that extend form an inside wall of the curved and continuous squeegee segment 443 and/or intersecting squeegee segments 445 that extend from an outer wall of the curved and continuous squeegee segment 443 to provide top wiping edges and side wiping edges. The curved and continuous squeegee segment 443 and the intersecting squeegee segments 445 and 447 protrude from a support surface 441 and can be surrounded or flanked by bristles or bristle sections 449 and 449' that also protrude from the support surface 441 and are preferably configured to wipe a working surface (not shown) simultaneously with the top wiping edges of the curved and continuous squeegee segment 443 and intersecting squeegee segments 445 and 447.

Figure 4F:
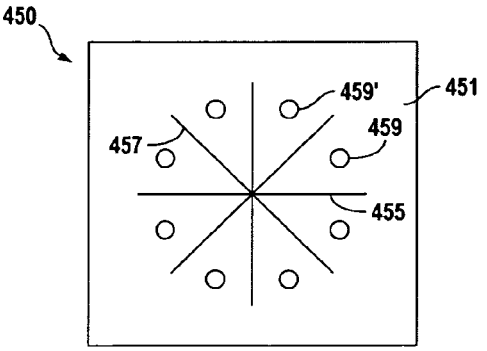

Referring now to FIG. 4F, a squeegee configuration 450, in accordance with the embodiments of the invention, comprises elongated squeegee segments 455 and 457 that intersect and extend at angles less than 90 degrees relative to each other and provide spoke-shaped top wiping edges and side wiping edges. The elongated squeegee segments 455 and 457 protrude from a support surface 451 and can be surrounded or flanked by bristles or bristle sections 459 and 459' that also protrude from the support surface 451 and are preferably configured to wipe a working surface (not shown) simultaneously with the top wiping edges of the elongated squeegee segments 455 and 457.

Figure 4G:
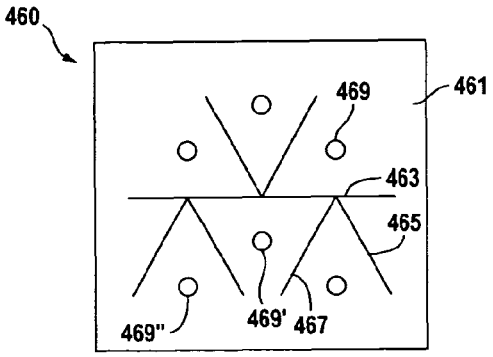

Referring now to FIG. 4G, a squeegee configuration 460, in accordance with the embodiments of the invention, comprises a major elongated squeegee segment 463 and a plurality of minor and intersecting squeegee segments 465 and 467 that intersect a wall of the major elongated segment 463 and extend form a wall of the major squeegee segment 463 at angles less than or greater than 90 degrees to provide top wiping edges and side wiping edges. The major squeegee segment 463 and the minor squeegee segments 465 and 467 can protrude from a support surface 461 and can be surrounded or flanked by bristles or bristle sections 469, 469' and 469" that also protrude from the support surface 461. The bristle sections 469, 469' and 469" are preferably configured to wipe a working surface (not shown) simultaneously with the top wiping edges of the elongated squeegee segments 463, 465 and 467.

Figure 4H:
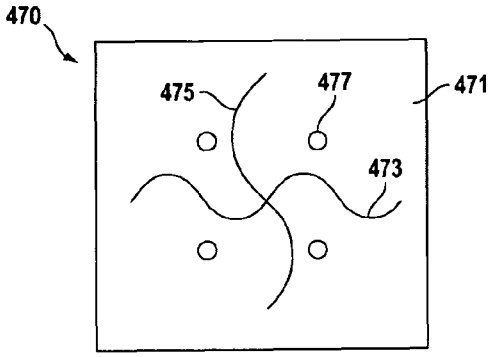

Referring now to FIG. 4H, a squeegee configuration 470, in accordance with the embodiments of the invention, comprises curved squeegee segments 473 and 475 that intersect and provide curved or wave-like top wiping edges and side wiping edges. One or more of the curved squeegee segments 473 and 475, or a portion thereof, protrude from a support surface 471 and can be surrounded or flanked by bristles or bristle sections 477 that also protrude from the support surface 471 and are preferably configured to wipe a working surface (not shown) simultaneously with the top wiping edges of the squeegee segments 473 and 475.

Figure 4I:
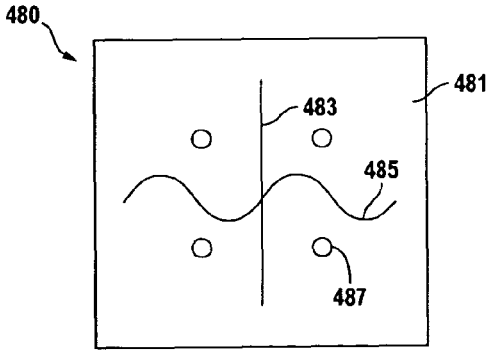

Referring now to FIG. 4I, a squeegee configuration 480 in accordance with the embodiments of the invention, comprises a linear squeegee segment 483 and a curved squeegee segment 485 that intersect and provide linear and curved top wiping edges and side wiping edges. One or more of the squeegee segments 483 and 485, or a portion thereof, protrude from a support surface 481 and can be surrounded or flanked by bristles or bristle sections 487 that also protrude from the support surface 481 and are preferably configured to wipe a working surface (not shown) simultaneously with the linear and curved top wiping edges of the squeegee segments 483 and 485.

Figure 4J:
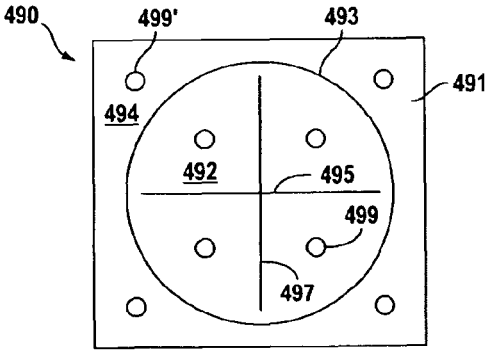

Referring now to FIG. 4J, a squeegee configuration 490, in accordance with the embodiments of the invention, comprises a continuous squeegee segment 493 that forms or bounds an inner squeegee region 492 and an outer squeegee region 494. The continuous squeegee segment 493 has a continuous top wiping edge that encircles or surrounds intersecting squeegee segments 495 and 497. The intersecting squeegee segments 495 and 497 provide cross-shaped top wiping edges and side wiping edges, as explained above. At least a portion of the continuous squeegee segment 493 and one or more of the intersecting squeegee segments 495 and 497 protrude from a support surface 491. Bristles can protrude from the support surface 491 corresponding to the inner squeegee region 492 (as with 499) the outer squeegee region 494 (as with 499') or both, such that the intersecting squeegee segments 495 and 497 and/or the continuous squeegee segment 493 are surrounded or flanked by bristles or bristle sections 499 and 499'. Preferably, the bristles or bristle sections 499 and 499' are configured to wipe a working surface (not shown) simultaneously with the top wiping edges of the squeegee segments 493, 495 and 497.

It will be clear to one skilled in the art from the description above with reference to FIGS. 1-3 that top wiping edges and side wiping edges of the squeegee segments described with reference to FIGS. 4A-J can be contoured, to corrugated, curved, pointed, angled, tapered or otherwise textured. While FIGS. 4A-J have all been described with bristles, bristles are not required. Further, any number of the features described above can be combined in different ways to provide other squeegee configurations that are considered to be within the scope of the invention. Also, it is understood that an abrasive material can be integral with the squeegee segment or attached to the walls or edges of the wiping surfaces as required for the application at hand. Further, it is understood that the squeegee configurations, in accordance with the embodiments of the invention, can include absorbent elements, such as sponge elements, and abrasive elements, such as scouring elements that are separate from the squeegee segments.

Figure 5:
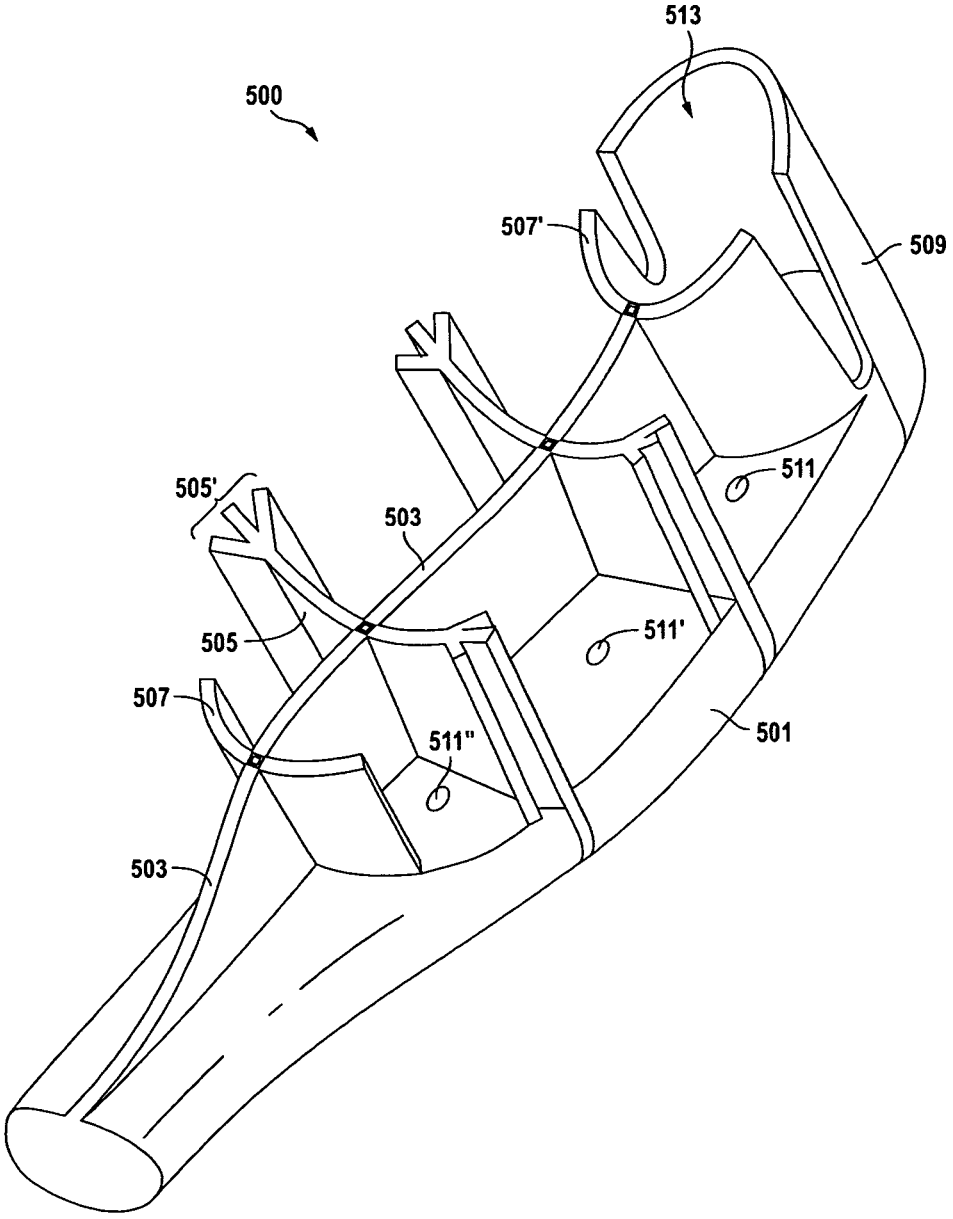
FIG. 5 shows a perspective view of a toothbrush cleaning head with a squeegee configuration with intersecting squeegee segments and bristles, in accordance with the embodiments of the invention.

FIG. 5 shows a perspective view of a toothbrush cleaning head 500, with a squeegee configuration, in accordance with the embodiments of the present invention. The toothbrush cleaning head 500 comprises an elongated squeegee segment 503 a plurality intersecting squeegee segments 505, 507 and 507'. The intersecting squeegee segment 505 comprises a plurality of squeegee fins 505' that fan out from the end of squeegee segment 505 to provide a plurality of side wiping edges and the squeegee segments 507 and 507' are preferably curved or contoured. The toothbrush cleaning head 500, in accordance with the embodiments of the invention, further comprises a curved squeegee segment 509, which forms a cup region 513 with the curved squeegee segment 507'. The squeegee configuration comprising the squeegee segments 503, 505, 507, 507' and 509 preferably provide curved and/or contoured top wiping edges.

Still referring to FIG. 5, the squeegee segments 503, 507 507' and 509 can also be configured with a plurality of squeegee fins (not shown) such described with reference to the squeegee fins as 505' to provide for a plurality of top wiping edges and side wiping edges in a compact region of the cleaning head 500. The cleaning head 500 can also include bristles and/or bristle sections schematically illustrated by circles 511, 511' and 511". Bristles and/or bristle sections (not shown) can also protrude from within the cup region 513. The bristles or bristle sections 511, 511' and 511" protrude from a support surface 501 and are preferably configured to wipe teeth and gums simultaneously with the top wiping edges of the squeegee segments 503, 505, 507, 507' and 509.

Figure 6:
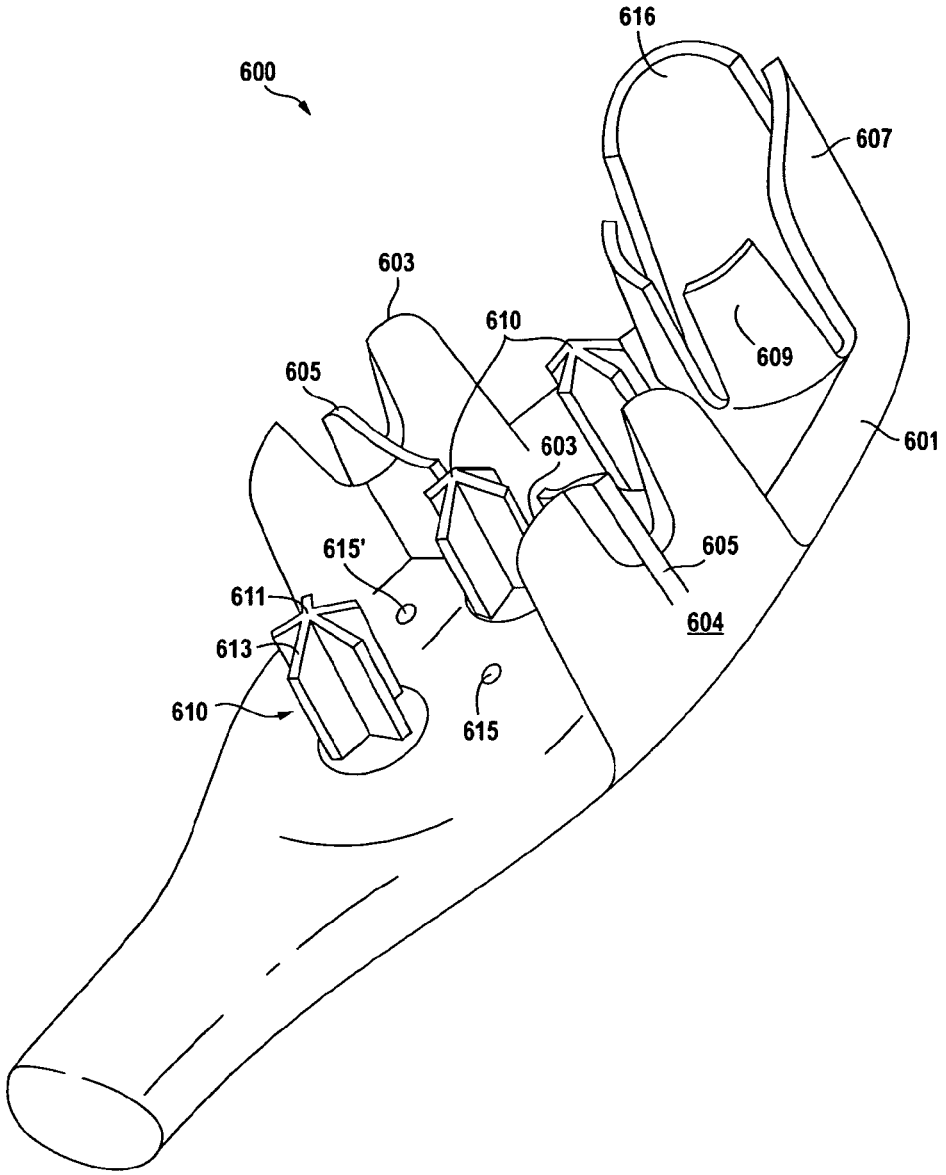
FIG. 6 shows a perspective view of a toothbrush cleaning head with a squeegee configuration having squeegee elements with intersecting squeegee segments and bristles, in accordance with further embodiments of the invention.

FIG. 6 shows a perspective view of a toothbrush cleaning head 600, with a squeegee configuration, in accordance with the embodiments of the present invention. The toothbrush cleaning head 600 comprises squeegee elements 604 and 610 that comprise intersecting squeegee segments 603 and 605, and 611 and 613, respectively. The squeegee elements 604 preferably comprises segments that have curved or contoured wiping edges and curved side wiping edges. The squeegee elements 610 preferably comprise squeegee segments 611 and 613 having pointed and cross-like top wiping edges. The squeegee configuration can also include any number of curved squeegee segments 607 and 609 that form a cup region 616. The cleaning head 600 can also include bristles and/or bristle sections illustrated by circles 615 and 615'. Also, bristles or bristle sections (not shown) can protrude from within the cup region 616. The bristles or bristle sections 615 and 615' preferably protrude from a support surface 601 and are preferably configured to wipe teeth and gums simultaneously with the top wiping edges of the squeegee elements 604, 607, 609 and 610.

Figure 7:
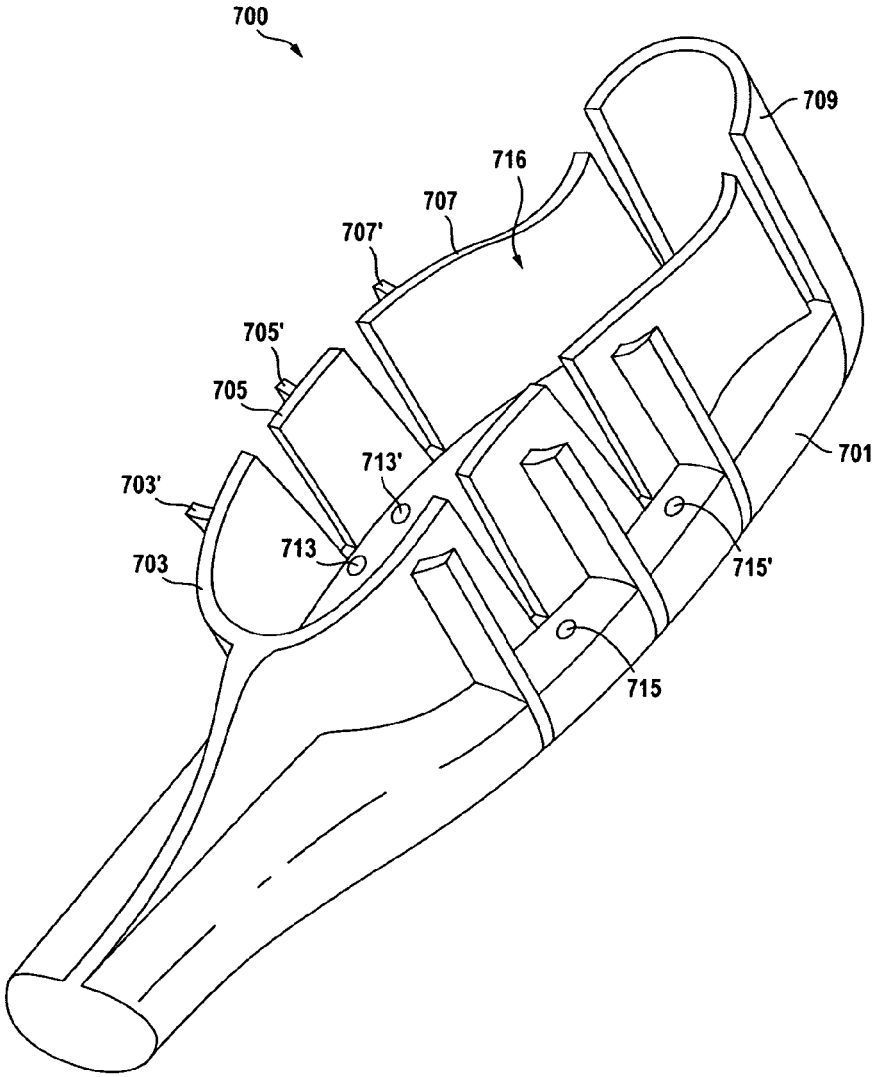
FIG. 7 shows a perspective view of a toothbrush cleaning head with intersecting squeegee segments and bristles, in accordance with yet further embodiments of the invention.

FIG. 7 shows a perspective view of a toothbrush cleaning head 700, with a squeegee configuration, in accordance with the embodiments of the present invention. The toothbrush cleaning head 700 comprises squeegee elements 703, 705 and 707 that comprise intersecting squeegee segments or squeegee fins 703', 705' and 707', respectively. The squeegee elements 703, 705 and 707 preferably provide curved or contoured wiping edges and side wiping edges. The squeegee configuration can also include a curved squeegee segment 709 forms a cup region 716 with walls of the squeegee elements 703, 705 and 707. The cleaning head 700 can also include bristles and/or bristle sections illustrated by the circles 713, 713', 715 and 715', which can surround or flank portions of the squeegee segments 703, 705 707 and 709. The bristles or bristle sections 713, 713', 715 and 715' preferably protrude from a support surface 701 and are configured to wipe teeth and gums simultaneously with the top wiping edges of the squeegee segments 703, 705, 707 and 709.

Figure 8:
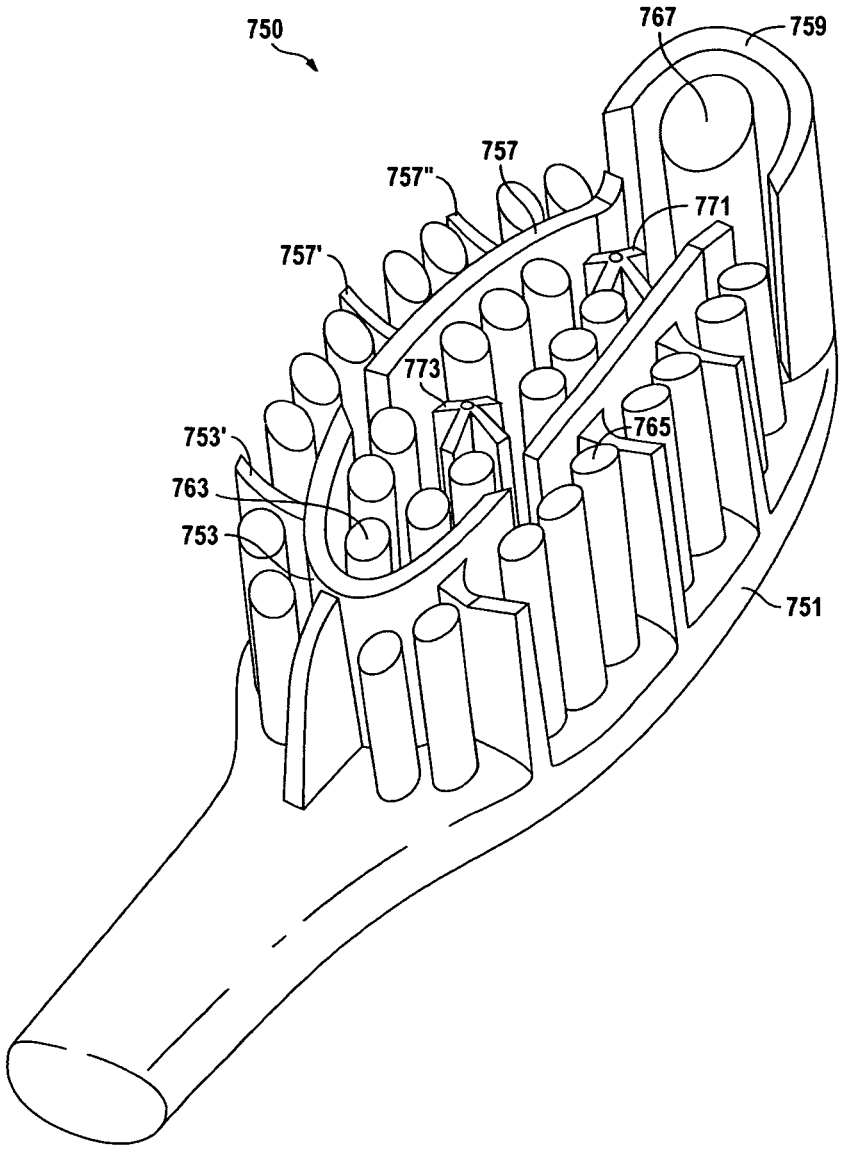
FIG. 8 shows a perspective view of a toothbrush cleaning head with intersecting squeegee segments and bristles, in accordance with still further embodiments of the invention.

FIG. 8 shows a perspective view of a toothbrush cleaning head 750, with a squeegee configuration similar to that described with reference to FIG. 7, and with inner bristle tufts 763 and outer bristle tufts 765. The toothbrush cleaning head 750 comprises squeegee elements 753 and 757 that comprise intersecting squeegee segments or squeegee fins 753', 757' and 757", respectively. The squeegee elements 753 and 757 preferably provide angled, tapered top and/or curved top wiping edges and side wiping edges. The squeegee configuration can also include a curved squeegee segment 759 that partially surrounds a bristle tuft 767. The squeegee elements 753, 757, 759 and the bristle tufts 763, 765 and 767 preferably protrude from a support surface 751 and are configured to wipe teeth and gums simultaneously with the squeegee elements 753, 757 and 759. The toothbrush cleaning head 750, in accordance with further embodiments of the invention, comprises cross-like squeegee elements 773 and 771 protruding from the support surface 751 and are preferably pointed, similar to those described with reference to FIG. 6.

Figure 9:
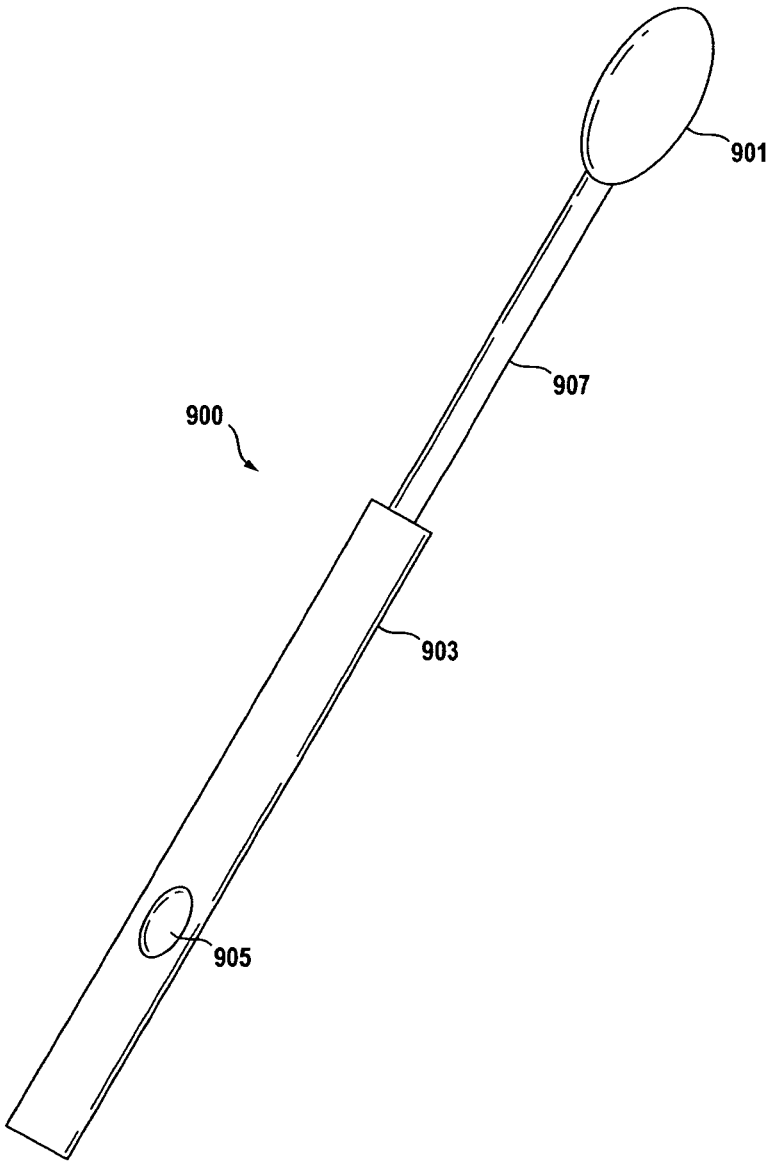
FIG. 9 shows a schematic representation of a motorized device comprising a motorized handle configured to vibrate, rotate and/or oscillate a cleaning head with intersecting squeegee segments, in accordance with the embodiments of the invention.

Now referring to FIG. 9, in accordance with the embodiments of the invention, an oral care system 900 comprises a toothbrush head 901 with one or more squeegee elements having two or more intersecting squeegee segments that provide top wiping edges and side wiping edges, such as described in detail above. The oral care system 900 is a manual toothbrush or an electrical toothbrush. Preferably, the toothbrush head 901 also comprises bristles or bristle sections, such as those described previously. The system 900 comprises a handle section 903 which can include a power supply and/or can be configured to couple to a power supply. If the system is an electric toothbrush, a power supply drives mechanisms in the handle section 903, in a neck portion 907, in the toothbrush head 901 or any combination thereof, which causes the squeegee elements, the bristles or a combination thereof, to rotate, oscillate, vibrate or otherwise move while cleaning teeth and gums. The handle portion 903 can include a switch 905 configured to start and stop the rotation, oscillation, vibration or other movement of the squeegee elements, the bristles or a portion thereof. Also, it will be clear to one skilled in the art that the toothbrush head 901 can be configured to replaceable, either alone or in combination with other components of the oral care system 900

The present invention provides an alternative dentition cleaning system and device to a brush-only system and device. Devices, in accordance with the embodiments of the invention, can be made to efficiently apply oral cleaning agents to teeth and gums and can be made to clean teeth and gums without requiring a high degree of technique or dexterity. Further, devices made in accordance with the embodiments of the invention can be less abrasive to both teeth and gums than a conventional bristle-only toothbrush.

It will be clear to one skilled in the art, from the description provided above, and the appended claims below, that the squeegee elements, squeegee segments, bristles and the features thereof can be combined in any number of different ways to make a cleaning device that provides top wiping surfaces and side wiping surfaces. Also, walls of squeegee segments, while generally shown as uniform herein, can vary in thickness in either an elongated direction, in a protruding direction or both. Accordingly, the proceeding preferred embodiment of the invention is set forth without any loss of generality to, and without imposing limitations upon, the claimed invention.

What is claimed is:

1. A device comprising:

a) squeegee elements, each of the squeegee elements having intersecting squeegee segments protruding upward from a support surface that is substantially planar, with each of the intersecting squeegee segments having a terminus end to provide an intersecting top wiping edge and three or more discrete side wiping edges;

b) a curved squeegee element protruding from the support surface to provide a curved top wiping edge; and c) bristles protruding from the support surface, wherein at least a portion of the bristles are surrounded by the curved squeegee element.

2. The device of claim 1, further comprising bristles that flank at least a portion of the top wiping edges.

3. The device of claim 1, wherein portions of the top wiping edges protrude from the support surface to a range of heights.

4. The device of claim 1, wherein at least one of the intersecting squeegee segments is curved.

5. The device of claim 1, wherein a portion of the intersecting squeegee segments are angled with respect to each other.

6. The device of claim 1, wherein a portion of the top wiping edges are contoured to be corrugated, rounded, angled or pointed.

7. The device of claim 1, wherein a portion of the side wiping edges are contoured to be corrugated, rounded, angled or pointed.

8. The device of claim 1, wherein the squeegee elements comprise tapered squeegee walls.

9. A device comprising a cleaning head comprising:

a) squeegee elements, each of the squeegee elements protruding upward from a support surface that is substantially planar and having squeegee segments with elongated walls that intersect at a common location and with each of the squeegee segments having a terminus end to form a corresponding intersecting top wiping edge and three or more discrete side wiping edges;

b) a curved squeegee element protruding from the support surface to provide a curved top wiping edge; and c) bristles protruding from the support surface and flanking the intersecting squeegee segments and the curved squeegee element.

10. The device of claim 9, wherein a portion of the top wiping edges are contoured to be corrugated, rounded, angled or pointed.

11. The device of claim 9, wherein a portion of the discrete side wiping edges are contoured to be corrugated, rounded, angled or pointed.

12. A device comprising:

a) a substantially vertical squeegee element, the squeegee element comprising three or more squeegee segments with intersecting squeegee walls that intersect at a common location and protruding upward from a substantially planar support surface to form a corresponding intersecting top wiping edge protruding from the substantially planar support surface, wherein each of the three or more squeegee segments have at least one discrete side wiping edge; and b) bristles protruding from the substantially planar support surface.

13. The device of claim 12, wherein a portion of the three or more squeegee segments is curved corrugated, rounded, angled or pointed.

14. A toothbrush comprising:

a) squeegee elements, each of the squeegee elements having three or more squeegee segments that protrude upward from a support surface and intersect at a common location with each of the squeegee segments having a discrete terminus end and form top wiping edges that are substantially parallel to the support surface and side wiping edges that are substantially perpendicular to the support surface;

b) a curved squeegee element with curved walls protruding from the support surface to provide a curved top wiping edge; and c) bristles protruding from the support surface a portion of which flank the squeegee segments and a portion of which are surrounded by the curved squeegee element.

* * * * *